US011317753B1

(12) United States Patent
Goelst

(10) Patent No.: US 11,317,753 B1
(45) Date of Patent: May 3, 2022

(54) PARTITION CURTAIN TRACK SYSTEM

(71) Applicant: KleenEdge, LLC, Seattle, WA (US)

(72) Inventor: Karen Goelst, Seattle, WA (US)

(73) Assignee: KLEENEDGE, LLC, Seattle, WA (US)

( * ) Notice: Subject to any disclaimer, the term of this patent is extended or adjusted under 35 U.S.C. 154(b) by 0 days.

(21) Appl. No.: 17/167,459

(22) Filed: Feb. 4, 2021

(51) Int. Cl.

| | |
|---|---|
| ***A47H 1/104*** | (2006.01) |
| ***A47H 1/144*** | (2006.01) |
| ***A47H 1/08*** | (2006.01) |
| ***A47H 1/06*** | (2006.01) |

(52) U.S. Cl.
CPC ..... *A47H 1/104* (2013.01); *A47H 1/06* (2013.01); *A47H 1/08* (2013.01); *A47H 1/144* (2013.01)

(58) Field of Classification Search
CPC ..... A47H 1/104; A47H 1/106; A47H 1/108; Y10T 403/34; Y10T 403/342; Y10T 403/343; Y10T 403/347
See application file for complete search history.

(56) References Cited

U.S. PATENT DOCUMENTS

| | | | | |
|---|---|---|---|---|
| 2,064,470 A | | 12/1936 | Heckman | |
| 2,264,642 A | | 12/1941 | Rowe | |
| 2,412,910 A | | 12/1946 | Rowe | |
| 3,331,095 A | | 7/1967 | Hachtel | |
| 3,396,834 A | | 8/1968 | Luckey | |
| 3,600,741 A | | 8/1971 | Bays | |
| 3,632,147 A | * | 1/1972 | Finger | A47F 5/14 403/171 |
| 3,685,662 A | | 8/1972 | Varon | |
| 3,823,439 A | | 7/1974 | Selset | |
| 3,891,091 A | * | 6/1975 | Anderson | A47H 1/08 211/105.3 |
| 3,913,204 A | | 10/1975 | Finkbeiner | |
| 4,126,921 A | | 11/1978 | Pape | |
| 4,145,149 A | * | 3/1979 | Ruga | E04B 1/1903 403/171 |
| 4,153,969 A | | 5/1979 | Mergenthaler | |
| 4,336,757 A | | 6/1982 | Toder | |

(Continued)

FOREIGN PATENT DOCUMENTS

| | | |
|---|---|---|
| AT | 294353 | 11/1971 |
| AT | 306280 | 4/1973 |

(Continued)

OTHER PUBLICATIONS

USPTO, Restriction/Election Requirement dated May 26, 2020 in U.S. Appl. No. 16/001,845.

(Continued)

*Primary Examiner* — Victor D Batson
*Assistant Examiner* — Matthew J Sullivan
(74) *Attorney, Agent, or Firm* — Snell & Wilmer L.L.P.

(57) ABSTRACT

The system includes a configurable partition curtain track. The partition track may be installed further away from the ceiling to allow other equipment to more easily traverse across the room, without the need to move or adjust the partition track. Moreover, the installation being further removed from the ceiling eliminates the need for a ladder when changing the curtain. The system may include one or more of a loading bracket, an omni cube, an angled tube, a suspension hanger, a wall mount, a handle, a track and/or a telescoping track.

16 Claims, 10 Drawing Sheets

(56) References Cited

U.S. PATENT DOCUMENTS

| | | | | |
|---|---|---|---|---|
| 4,569,164 | A | 2/1986 | Dickson | |
| 4,904,108 | A * | 2/1990 | Wendel | E04B 1/1912 403/170 |
| 5,022,454 | A | 6/1991 | Kobayashi | |
| 5,329,857 | A | 7/1994 | Owens | |
| 5,425,409 | A | 6/1995 | Guia | |
| 5,513,419 | A | 5/1996 | Zinger | |
| 5,518,058 | A | 5/1996 | Gastmann | |
| 5,659,926 | A | 8/1997 | Dietrich | |
| 6,047,761 | A | 4/2000 | Jaehnen | |
| 7,059,379 | B2 | 6/2006 | Lewis, Jr | |
| 7,128,123 | B2 | 10/2006 | Mullet | |
| 7,861,762 | B2 | 1/2011 | Meichtry | |
| 8,528,622 | B2 | 9/2013 | Ehrlich | |
| 8,869,869 | B2 * | 10/2014 | Graneto, III | A47H 13/01 160/341 |
| 9,149,144 | B2 * | 10/2015 | Graneto, III | A47H 5/14 |
| 9,211,027 | B2 * | 12/2015 | Ovist | A47H 1/102 |
| 9,583,926 | B2 * | 2/2017 | Ye | H02G 3/125 |
| 9,995,034 | B2 * | 6/2018 | Rothenberg | E04B 1/34384 |
| 10,085,582 | B2 * | 10/2018 | Zahner | A47H 1/08 |
| 10,231,563 | B2 | 3/2019 | Colacecchi | |
| 10,258,183 | B2 | 4/2019 | Zsarik | |
| 10,609,894 | B1 * | 4/2020 | Bartley | E04H 1/1272 |
| 2013/0276382 | A1 * | 10/2013 | Workman | E04B 1/34384 52/63 |
| 2013/0312333 | A1 | 11/2013 | Liao | |
| 2014/0208545 | A1 | 7/2014 | Jang | |
| 2015/0173549 | A1 * | 6/2015 | Zahner | A47H 13/02 160/330 |
| 2019/0316399 | A1 | 10/2019 | Sauve | |
| 2020/0109585 | A1 | 4/2020 | Lee | |

FOREIGN PATENT DOCUMENTS

| | | | |
|---|---|---|---|
| AT | 364701 | | 11/1981 |
| AT | 408714 | | 2/2002 |
| DE | 2062836 | | 7/1972 |
| DE | 2213344 | | 1/1973 |
| DE | 2141911 | | 3/1973 |
| DE | 2947255 | | 6/1981 |
| DE | 3039942 | | 5/1982 |
| DE | 3233738 | | 3/1984 |
| DE | 3315218 | | 10/1984 |
| DE | 3607807 | | 9/1986 |
| DE | 4334717 | | 11/1995 |
| DE | 29604182 | | 5/1996 |
| DE | 20000078 | | 4/2000 |
| DE | 4410805 | | 10/2005 |
| DE | 102005005857 | | 8/2007 |
| DE | 102013111085 | | 4/2015 |
| EP | 0601306 | | 1/1997 |
| GB | 489851 | | 7/1938 |
| GB | 646085 | A * | 11/1950 |
| GB | 1235271 | | 6/1971 |
| GB | 2215987 | | 10/1989 |
| GB | 2334432 | | 8/1999 |

OTHER PUBLICATIONS

USPTO, Non-Final Office Action dated Jun. 15, 2020 in U.S. Appl. No. 16/001,845.

USPTO, Final Office Action dated Dec. 30, 2020 in U.S. Appl. No. 16/001,845.

USPTO, Notice of Allowance dated Jan. 22, 2021 in U.S. Appl. No. 16/001,845.

* cited by examiner

PARTITION CURTAIN TRACK SYSTEM

TECHNICAL FIELD

This disclosure generally relates to curtain tracks, and more particularly, to adjustable partition curtain tracks, brackets and supports.

BACKGROUND

Partition curtains that are mounted on tracks are often used in hospitals, healthcare facilities and other buildings to provide privacy and patient comfort. The partition tracks are often installed near the ceiling or around patient beds such that the curtain may be drawn next to the patient bed. However, existing tracks often extend into the room without any supporting brackets at the end of the bracket (the end away from the wall) such that the existing tracks are unstable. When staff try to pull on the curtain, the track bends down away from the ceiling which may cause stress on the brackets, permanent deformation or other functionality problems with the track. Moreover, the track often telescopes out to a maximum distance away from the wall of 118 inches, which leaves a large gap in curtain coverage at the foot of a typical hospital bed.

The tracks are typically mounted from the ceiling or near the ceiling. The tracks are often supported by a short, straight bracket emanating from the ceiling to provide more stability. Because of the shorter bracket, the track needs to be closer to the ceiling. Such a higher installation point also usually requires hospital staff to use a ladder to exchange the curtains mounted on the tracks. The higher installation point also typically causes the need to install a draw stick for reaching the top of the curtain to better assert force to move the partition curtain. The draw stick frequently falls off the curtain, thereby requiring reattachment (again with the use of a ladder). The draw stick may also get lost. Furthermore, the draw stick may hit the staff walking by such that the staff is motivated to remove the draw stick, which renders the system inoperable.

Additionally, many of the tracks that support the partition curtains tend to interfere with the use of equipment in the hospital room, as shown in prior art FIG. 1. For example, equipment (e.g., ceiling mounted lamps, ceiling mounted x-ray equipment and motorized patient lifts) is typically mounted such that the patient has access from the bed to the equipment. These systems usually consist of two large stationary tracks installed at the ceiling, and the tracks extend from the foot of the patient bed and to the head of the patient bed. A traversing track (that carries the lamp, diagnostic equipment and/or patient seat (or cradle)) moves from the back of the bed to the front of the bed, along with moving from the left side of the bed to the right side of the bed. With the lift, the range of the track allows the patient to be transported across the room. However, the tracks for a typical privacy curtain often interfere with the tracks for the mounted equipment such that the typical privacy track may impede the range of the patient lift. Some systems may allow the staff to use the draw stick to push the curtain away from the path of the lift equipment, wherein the telescoping curtain rail is also retracted with the same motion of the draw stick to allow the lift equipment to pass by. However, the movement of the curtain and the track is typically inconvenient, difficult and the staff often forget to pull the curtain and track back into their original extended position.

SUMMARY

The system includes a configurable partition curtain track. The partition track may be installed further away from the ceiling to allow other equipment to more easily traverse across the room, without the need to move or adjust the partition track. Moreover, the installation being further removed from the ceiling eliminates the need for a ladder when changing the curtain. The system may include one or more of a loading bracket, an omni cube, an angled tube, a suspension hanger, a wall mount, a handle, a track and/or a telescoping track.

The partition curtain system may comprise an omni cube having a plurality of holes a track having a first end and a second end; the first end of the track interfacing with a wall; and the second end of the track interfacing with one of the plurality of holes in the omni cube.

The system may further comprise a loading bracket configured to interface with the track. The system may further comprise an angled tube configured to support the track. The system may further comprise one or more angled tubes configured to support the omni cube. The system may further comprise two angled tubes in a "V" configuration that are configured to support the omni cube. The system may further comprise an angled tube having a first end and a second end, wherein the first end of the angled tube is configured to interface with one of the plurality of holes in the omni cube, and wherein the second end of the angled tube is configured to interface with a ceiling of a room. The system may further comprise a suspension hanger configured to support the track. The system may further comprise a handle configured to interface with the track.

The track may be a telescoping track comprised of a female portion that is configured to receive a male portion. The system may further comprise a wall mount configured to interface with the first end of the track. The omni cube may be a PC/ABS blend with 10-15% glass fill. The system may further comprise at least one of a platform or a bar interfacing with the omni cube. The system may further comprise a cover configured to mount over a face of the omni cube.

The system may further comprise a first angled tube configured to interface with a first face of the omni cube; a second angled tube configured to interface with a second face of the omni cube; a third angled tube configured to interface with a third face of the omni cube; and wherein the track is a telescoping track that is configured to interface with a fourth face of the omni cube.

The system may further comprise the track comprises a first track, a second track and a third track; the first track is configured to interface with a first face of the omni cube; the second track is configured to interface with a second face of the omni cube; and the third track is a telescoping track that is configured to interface with a third face of the omni cube.

BRIEF DESCRIPTION OF THE DRAWINGS

The accompanying drawings, wherein like numerals depict like elements, illustrate exemplary embodiments of the present disclosure, and together with the description, serve to explain the principles of the disclosure. In the drawings.

DETAILED DESCRIPTION

Figure 1:
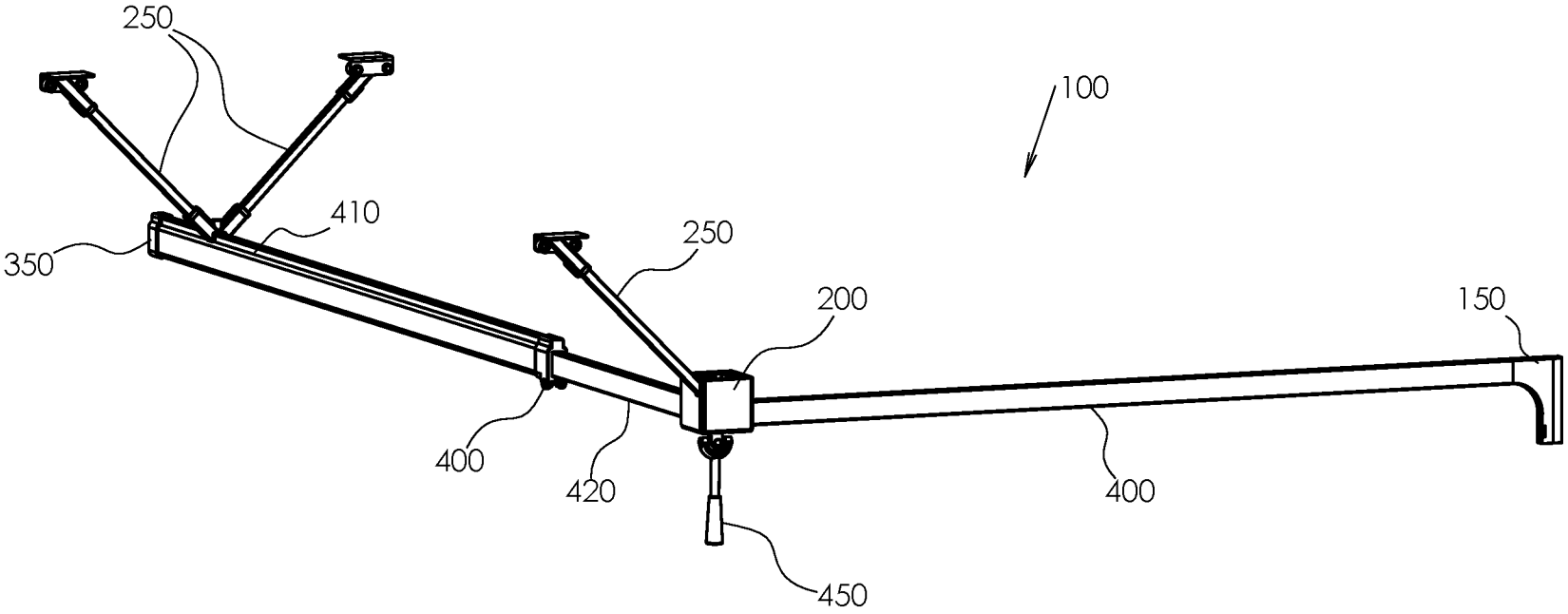
FIG. 1 illustrates a track system with the different parts, in accordance with various embodiments.

A configurable partition curtain track system 100 is disclosed. The partition track 400 may be installed further away from the ceiling to allow other equipment to more easily traverse across the room, without the need to move or adjust the partition track 400. Moreover, the installation being further removed from the ceiling eliminates the need for a ladder when changing the curtain. In various embodiments, with respect to FIG. 1, the system 100 may include one or more of a loading bracket 150, an omni cube 200, an angled tube 250, a wall mount 350, a handle 450, a track 400 and/or a telescoping track 400.

Each of the parts may be any size, shape or configuration. The number or selection of parts, along with the size, shape or configuration of each part may depend on the specific track 400 configuration, the wall material, the room configuration, items in the room, access needed, patient needs, hospital needs, staff needs, etc. Any of these parts (or components of the parts) may be comprised of aluminum, plastic, steel, alloy or any other material or composite. For example, at least some of the parts may include a PC/ABS blend. One or more of the parts may also include a glass fill. The glass fill may comprise 10-15% of the material. The parts may be fabricated using injection molding or die cast (e.g., zink or zamak).

In various embodiments, with respect to FIG. 1, the loading bracket 150 may include any bracket that supports the track and/or allows the curtain to be loaded into the track 400 and/or restrict the curtain from leaving the track 400. For example, the loading bracket 150 may include a quick load bracket as set forth in application Ser. No. 16/001,845 filed on Jun. 6, 2018 and entitled "RETROFIT CURTAIN ASSEMBLY," which is hereby incorporated by reference in its entirety for all purposes. While the system 100 described herein may include a loading bracket 150, the system 100 also contemplates not needing a loading bracket 150 such that the system 100 includes a track 400 that allows the curtain to be loaded into the track 400 directly, curtain clips/rings that may stay within the track when removing the curtain, and/or the loading of the curtain via any other of the components discussed herein.

In various embodiments, with respect to FIGS. 1-6, the omni cube 200 may be configured to connect with any of the other parts discussed herein, or any additional parts. The additional parts may be an exercise device, a platform (to hold a meal tray, laptop, iPad, etc), a bar to help the patient lift/move and/or the like. The omni cube 200 may include any number of sides. For example, the omni cube 200 may be a 6-sided cube. Each side may have the same or different configurations. Each side of omni cube may be 3 inches wide. A side may include any type of holes (e.g., slots, recesses, etc.) that are configured to interface with or receive other parts. Each side may have the same or different number, shape or location of holes. The holes may lock the parts into the omni bracket. One or more set screws 240 may be located anywhere on the omni cube 200. The set screws 240 may further help to restrict or lock the parts into the omni cube 200. The set screw 240 may be configured to interface with the part and provide pressure or friction against the part. The set screw 240 may be configured to screw into a receiving hole within the part.

Figure 2:
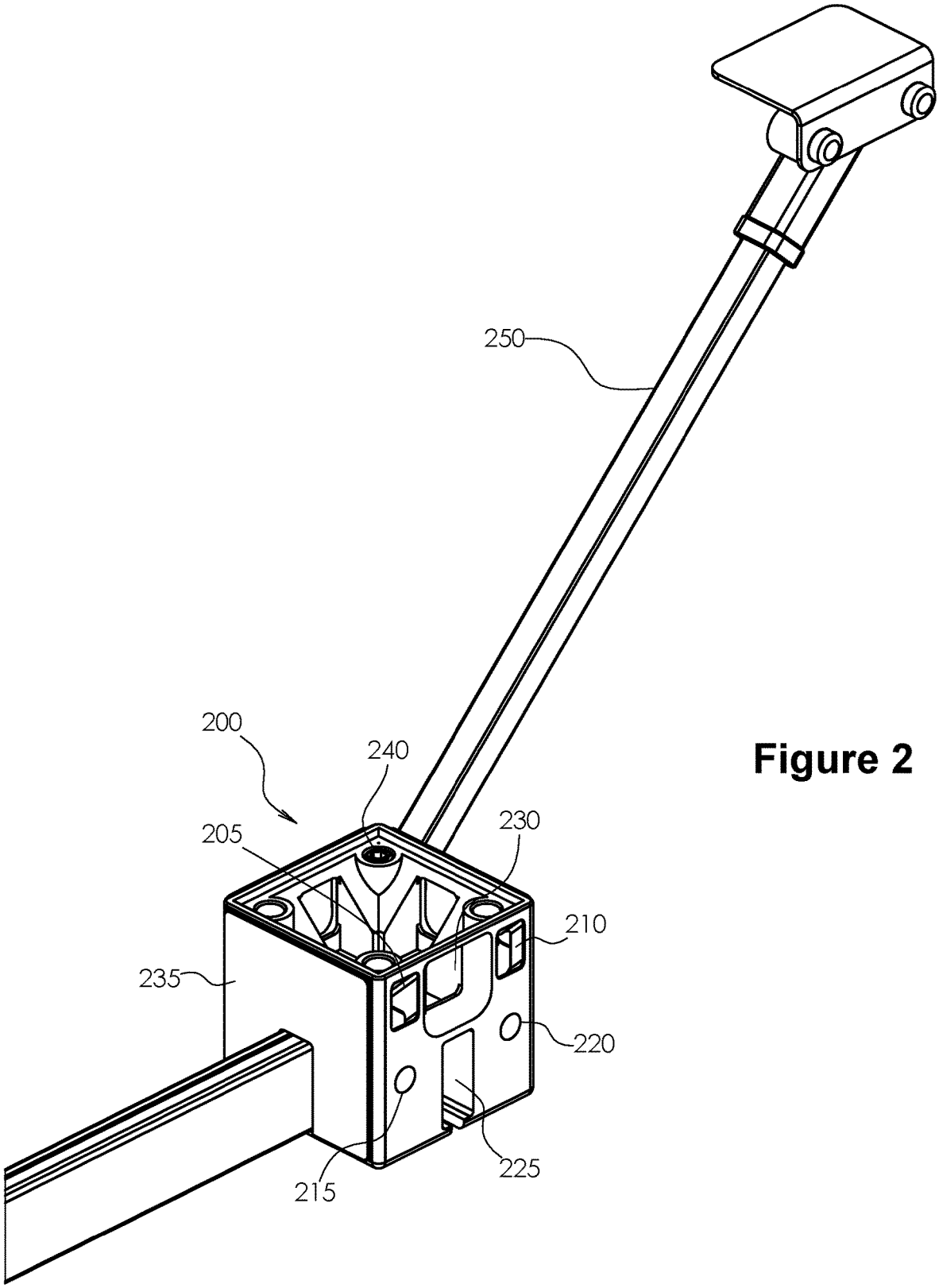
FIG. 2 illustrates an omni cube, in accordance with various embodiments.
Figure 6:
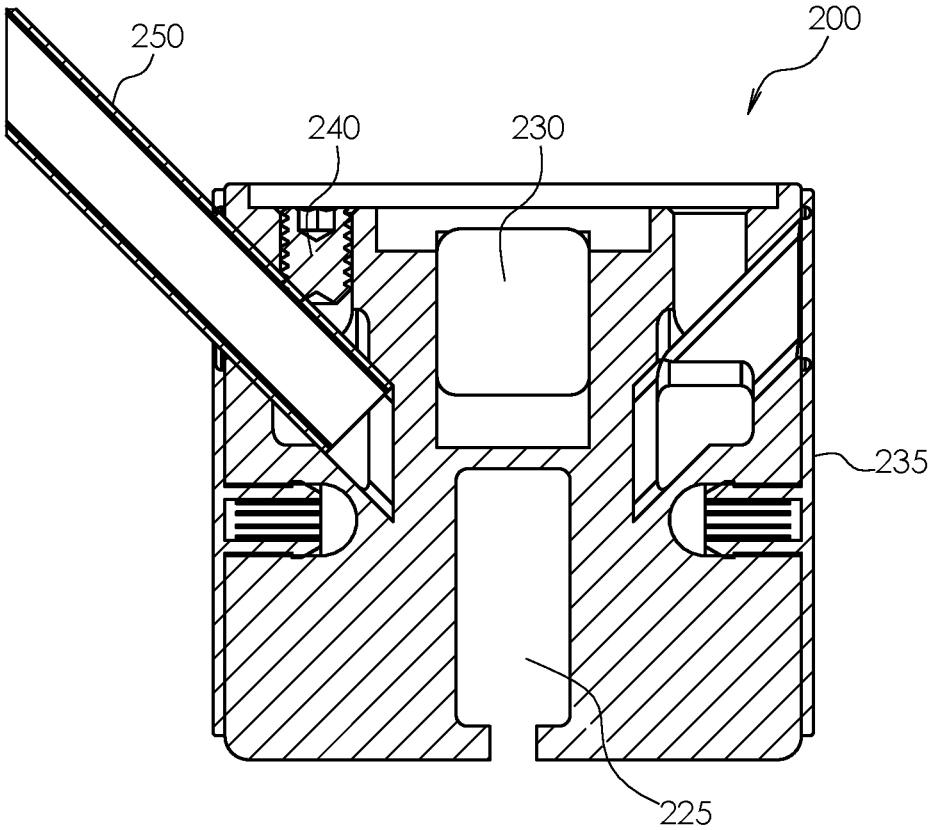
FIG. 6 illustrates a section view of an omni cube, in accordance with various embodiments.
Figure 7:
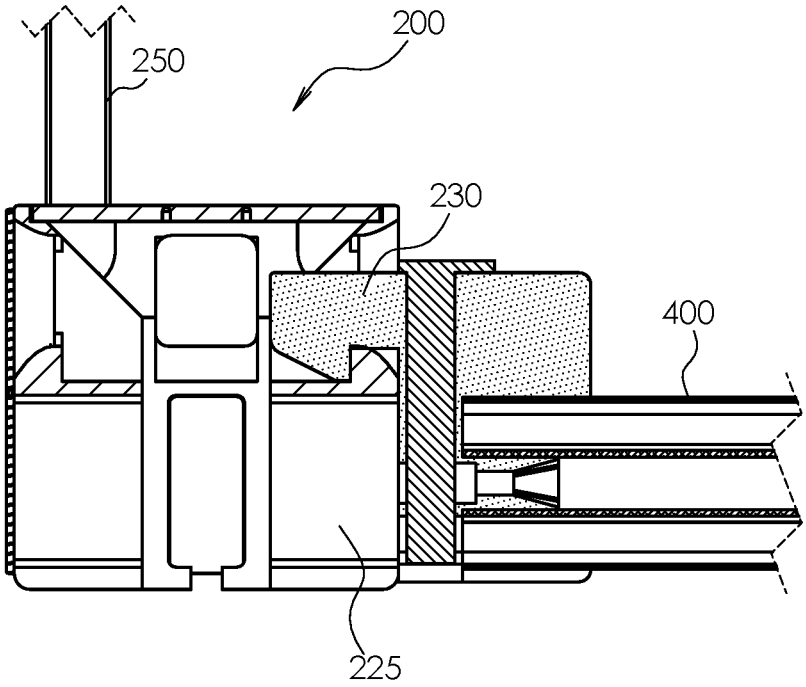
FIG. 7 illustrates an exemplary omni cube receiving a nose of a sliding bracket, in accordance with various embodiments.

With respect to FIGS. 2 and 6, holes 205, 210 may be configured to receive angled bracket 250. Holes 215, 220 may be configured to receive protrusions located on the cover 235, in order to secure the cover 235 over the face of the omni cube 200. As shown in FIGS. 6-7, a similar hole 225 and hole 230 may exist on one or more sides of omni cube 200. FIG. 7 is a cutaway view showing a side view of holes 225, 230, wherein hole 225 may be configured to receive a track 400. Hole 225 may include a bottom opening that is ¼ inches wide. Hole 230 may be configured to receive a "nose" of a sliding bracket that carries the handle 450. The nose is configured to lock the track into the omni cube. As shown in FIG. 6, in various embodiments, a cover 235 may interface with one or more sides of the omni cube 200. The cover 235 may cover one or more of the holes in the omni cube 200. In various embodiments, the cover 235 may have a cutout to allow one or more of the holes to be accessible while the cover 235 is in place on the omni cube 200.

Figure 3:
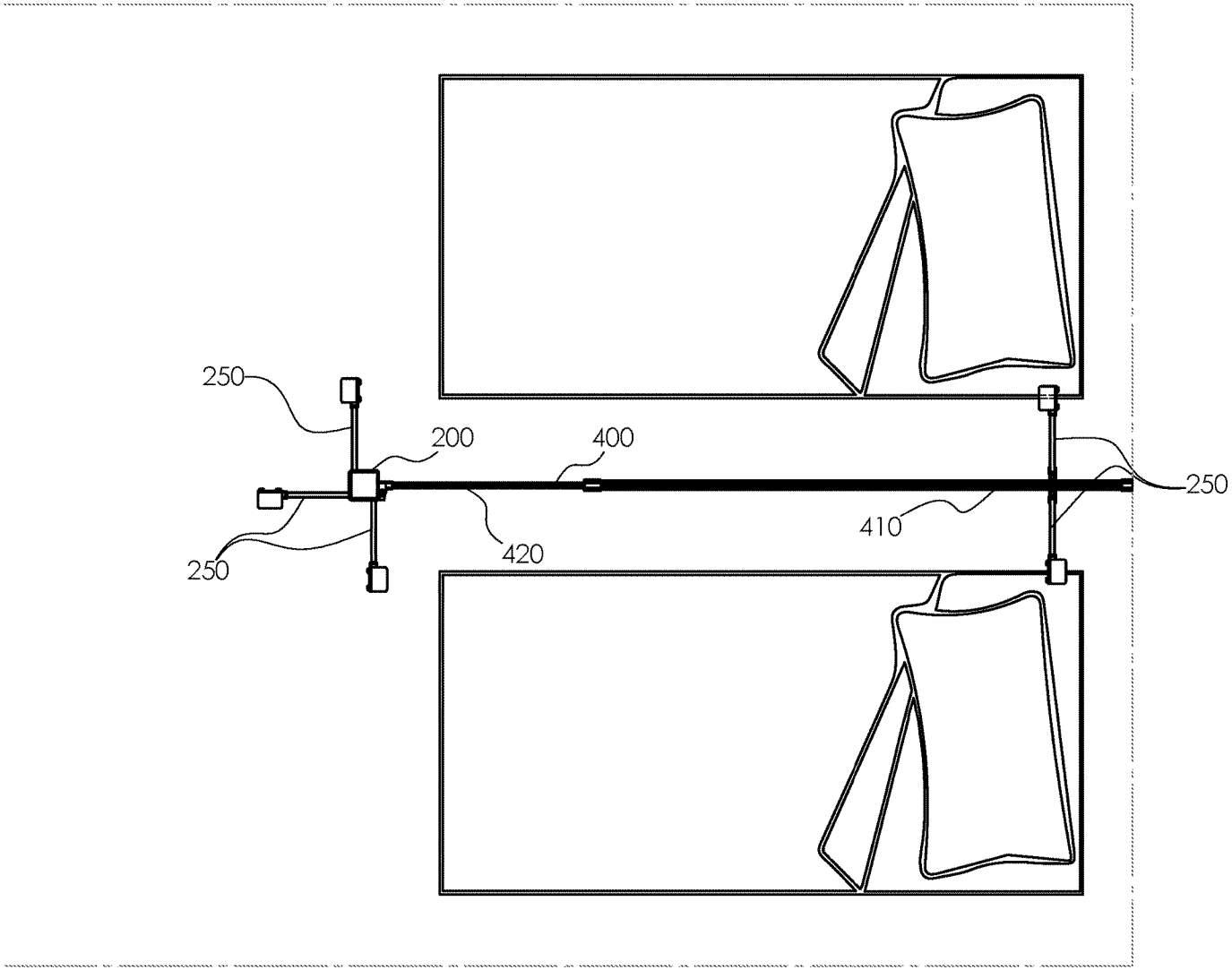
FIG. 3 illustrates a track system with an omni cube with 3 angled tubes, in accordance with various embodiments.

In various embodiments, with respect to FIGS. 1 and 3, the angled tube 250 may be any device configured to provide support between a surface (e.g., the ceiling) and the omni cube 200, the track 400 and/or any other part. One or more angled tubes 250 may be installed into system 100, depending on the amount of support needed by the omni cube 200. As such, the angled tube 250 providing support for the omni cube 200 allows the system 100 to include longer tracks 400. Such longer tracks may extend from a wall to the end (or past the end) of a hospital bed. Thus, the curtain may be pulled fully past the end of the bed and/or around the bed. In various embodiments, the angled tubes 250 may be ½ inch in diameter and the bracket holding the tube may be about 2 3/16 inches in length. The angled tubes 250 may be mounted to the ceiling at about 20 inches apart and be angled at about 90 degrees from each other. The distance from the ceiling to the bottom of track 400 may be about 12 inches. The angled tube 250 may be configured to interface with the track 400 at any angle with respect to the track 400. The first end of the angled tube 250 may interface and/or connect with a beam or other component in the surface (e.g., ceiling beam). The first end of the angled tube 250 may interface and/or connect with a bracket, and the bracket may be mounted on the surface, as shown in FIG. 1. The second end of the angled tube 250 may interface and/or connect with the omni cube 200, the track 400 or any other part. When two or more angled tubes 250 are used, the second ends of each of the angled tube 250*s* may interface with a V bracket. The V bracket may also interface with the track 400, as shown in FIG. 1. The connections may be secured by a bolt or any other fastener.

Figure 8:
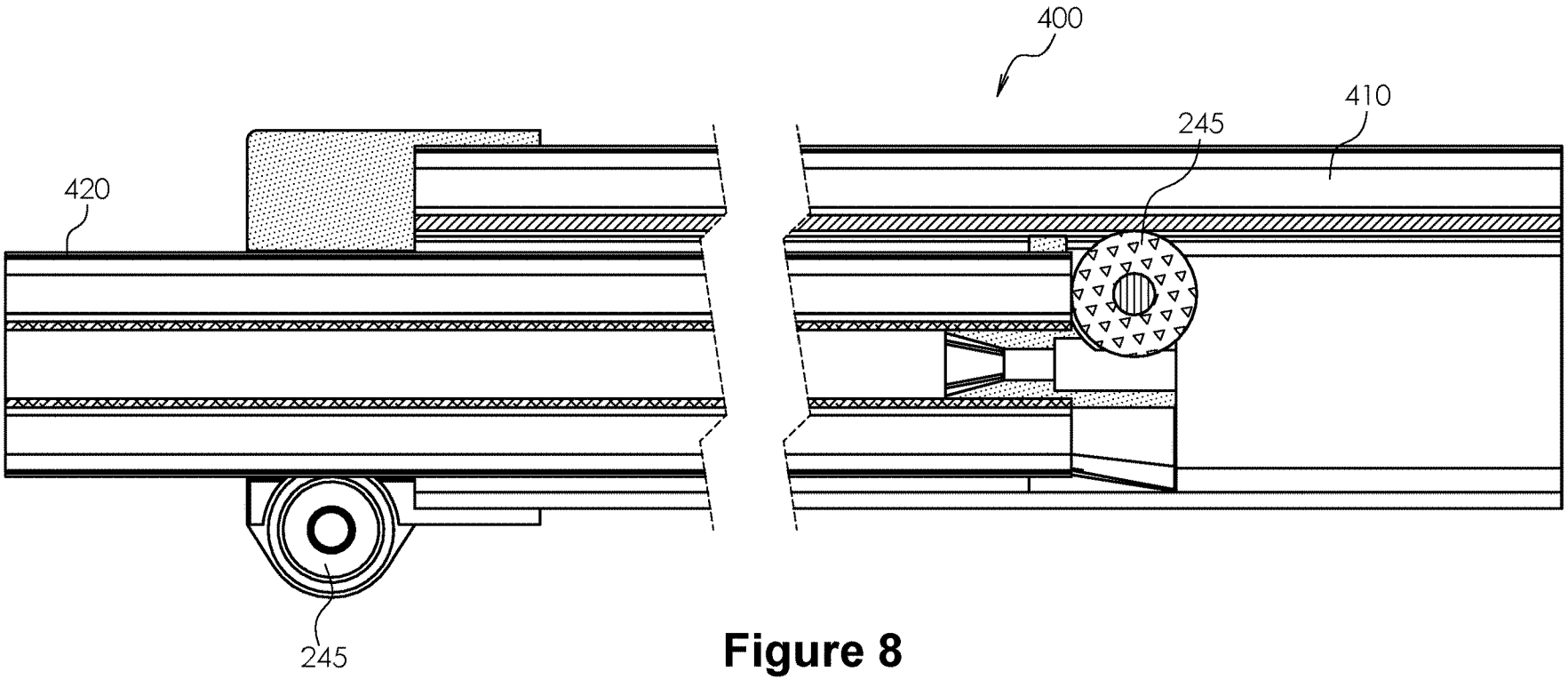
FIG. 8 illustrates an exemplary male rail inside of an exemplary female rail with the corresponding wheels and ramp that allow the curtain hangers to slide from one to the next, in accordance with various embodiments.

The number and placement of angled tubes 250 (e.g., amount of support needed) may depend on the weight of the various parts, how much the various parts extend out from a wall or ceiling, extent of use of the curtain, the forces that may be exerted on the system 100, etc. For example, as set forth in FIG. 3, if a first end of a track 400 extends from a wall, without the second end of the track 400 terminating into a connection to a perpendicular track 400, then the second end of the track 400 may interface into an omni cube 200, wherein the omni cube 200 is further supported by 1-3 angled brackets. However, as set forth in FIG. 4, if a first end of a track 400 extends from a wall, with the second end of the track 400 terminating into a connection to a perpendicular track 400, then the second end of the track 400 may interface into an omni cube 200, wherein the omni cube 200 is supported by less (e.g., 0-1) angled brackets. When one end of track 400 is mounted to a wall, then the system may include only one angled ceiling bracket at the opposite end of the larger (female) track 410 near the wheeled bushing 245 (as shown in FIG. 8). Depending on the length of the track 400, in various embodiments, track 400 may include a suspension hanger to support the track 400 at any point on the track. In various embodiments, angled tubes 250 may be used in any configuration where force may be applied to the track in any direction other than perpendicular with the ceiling or floor. In other words, angled tubes 250 are used to secure the track, where force may be applied to the track other than parallel to the force of gravity.

In various embodiments, a suspension hanger and/or angled tubes 250 may be any device configured to provide support between a surface (e.g., the ceiling) and a track 400 or any other part. The suspension hanger may be configured to be substantially or fully perpendicular to the track 400, or at any other angle with respect to the track 400. The first end of the suspension hanger may interface and/or connect with a beam or other component in the surface (e.g., ceiling beam). The second end of the suspension hanger may interface and/or connect with any part of the track 400. The suspension hanger may connect on the female portion 410 of the telescoping track 400, so as to not interfere with the extending of the male portion 420 of the telescoping track 400. The suspension hanger may connect to the top and/or sides of the track 400 to avoid interfering with the curtain movement. The connections may be secured by a bolt or any other fastener. The wider collar allows the pipe to be cut imprecisely and installed into the collar at whatever depth is necessary to level the rail.

In various embodiments, with respect to FIG. 1, the wall mount 350 is any device configured to provide an interface and/or support between a track 400 and a surface (e.g., wall). A first end of wall mount 350 may interface and/or connect with the surface material or other component in the surface (e.g., beam). The connections may be secured by a bolt or any other fastener. The wall mount 350 may receive an end of the track 400 (e.g., the female portion 410 of the track 400). The wall mount 350 may include a set screw 240 or other fastener to secure the track 400 within the wall mount 350. One or both ends of any track 400 may interface with a wall mount 350, a loading bracket 150 or an omni cube 200.

Figure 4:
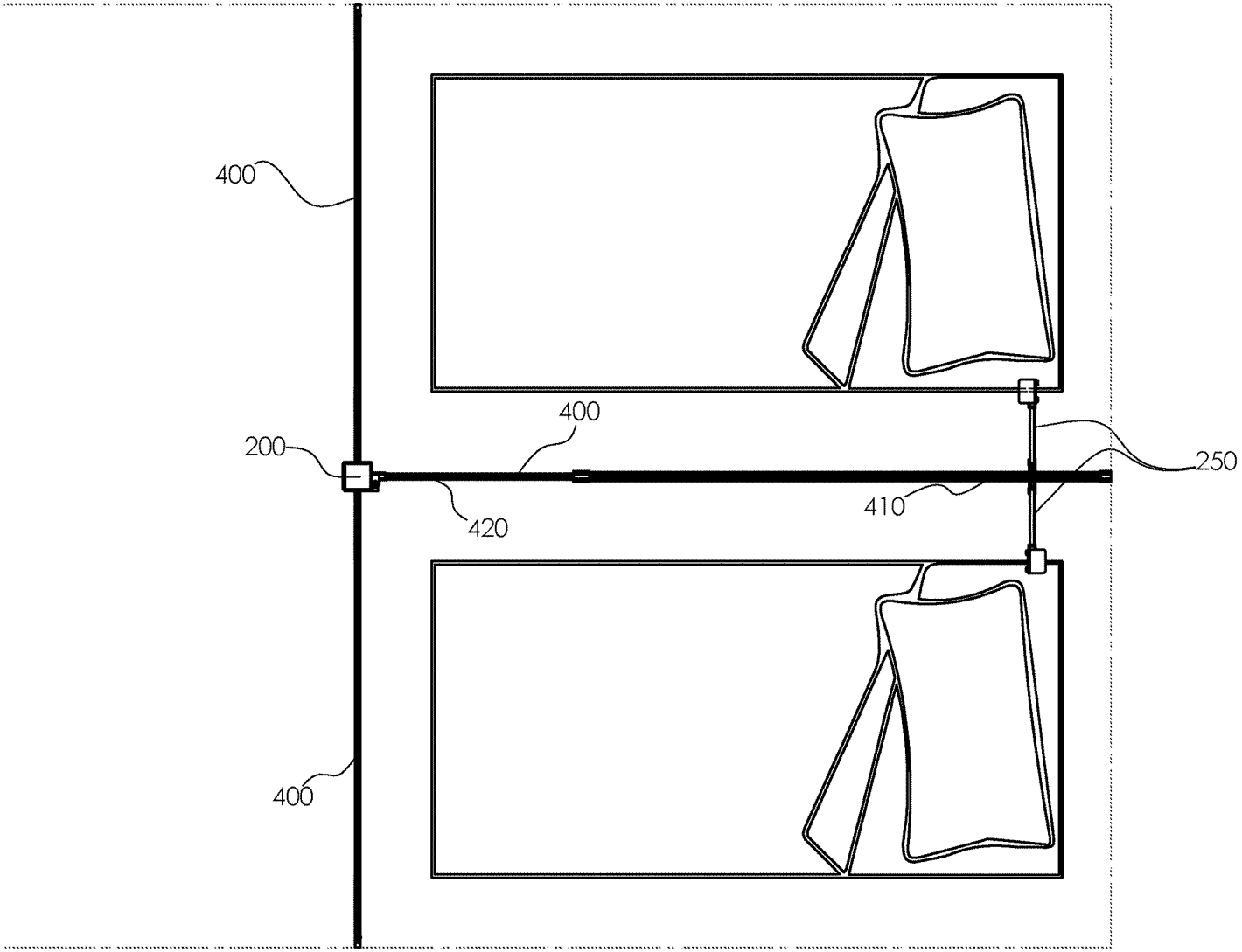
FIG. 4 illustrates a track system with an omni cube supporting perpendicular tracks, in accordance with various embodiments.
Figure 5:
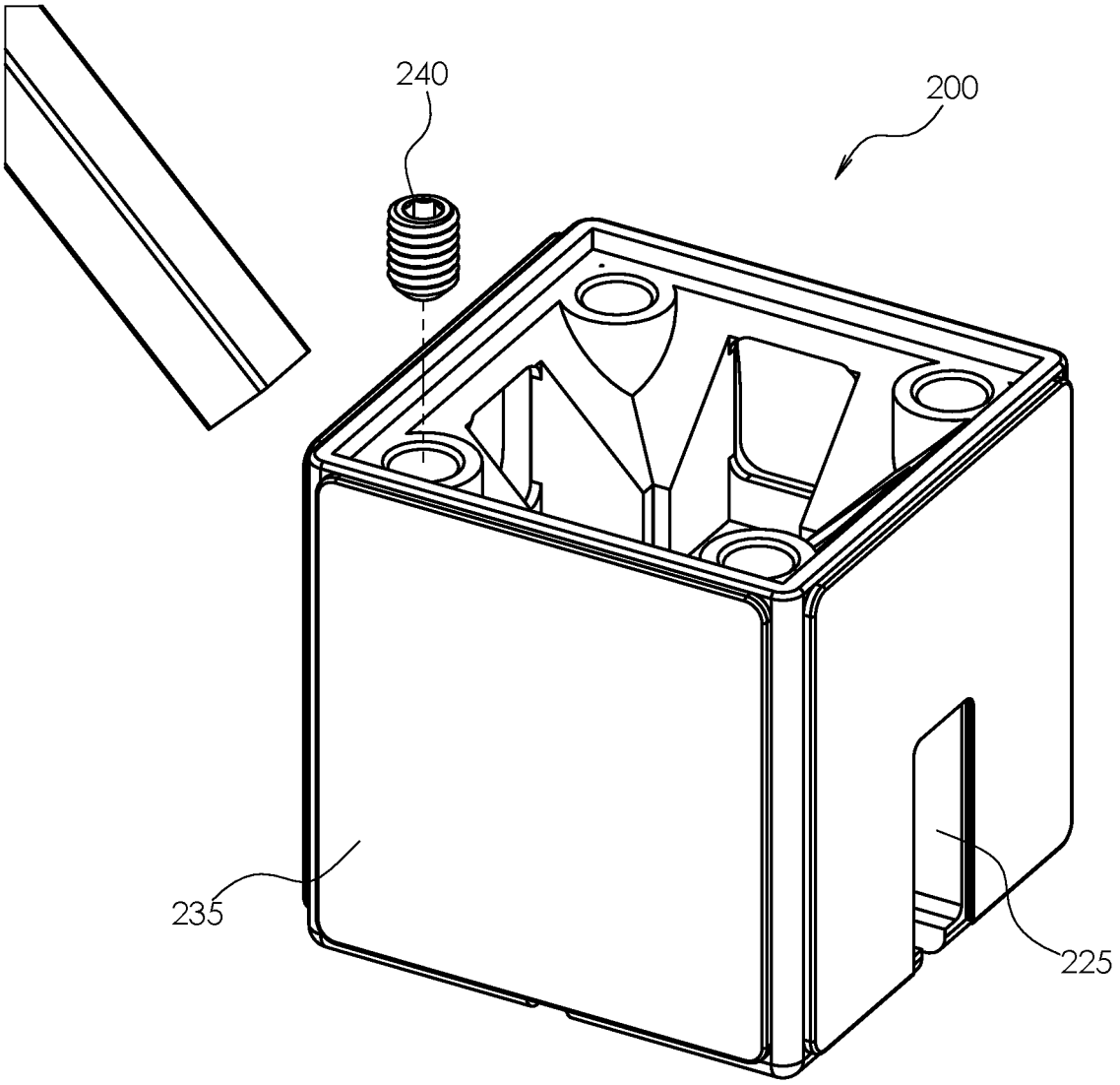
FIG. 5 illustrates an omni cube with a set screw 240, in accordance with various embodiments.

In various embodiments, with respect to FIGS. 1, 3 and 4, the track 400 includes any device configured to support a curtain. For example, the track may be $2\frac{13}{16}$ inches in height and $1\frac{13}{16}$ inches in width. Male track 420 may be $1\frac{5}{16}$ inches in height and female track 410 may be $2\frac{3}{16}$ inches in height. Track 400 may have a channel to support a curtain and/or to support curtain rings. One or more channels (of any size) may be on the bottom, side or top of track 400. The track 400 is also configured to allow a curtain to translate along the track 400. In various embodiments, as shown in FIG. 8, any portion of the track 400 may include a telescoping track 400. The telescoping track 400 may comprise a female track 410 that receives a male track 420. The female track 410 may retain the male track 420 with any type of friction or locking mechanism. Wheels or bearings 245 help to facilitate the movement of the male track 420 in and out of the female track 410. The curtain may still translate across the female portion 410 and male portion 420 of the track 400 by gliding over a ramp that serves as the transferring element. The ramp may be located on an end of the male portion 420 such that the curtain hanger elements may slide along the female portion 410, then up the ramp and into the male portion 420. The first end of track 400 may interface and/or mount into a wall mount 350 and the second end of track 400 may mount into an omni cube 200. The first end of track 400 may also interface and/or mount into a first omni cube 200, and the second end of track 400 may interface and/or mount into a second omni cube 200.

Figure 9:
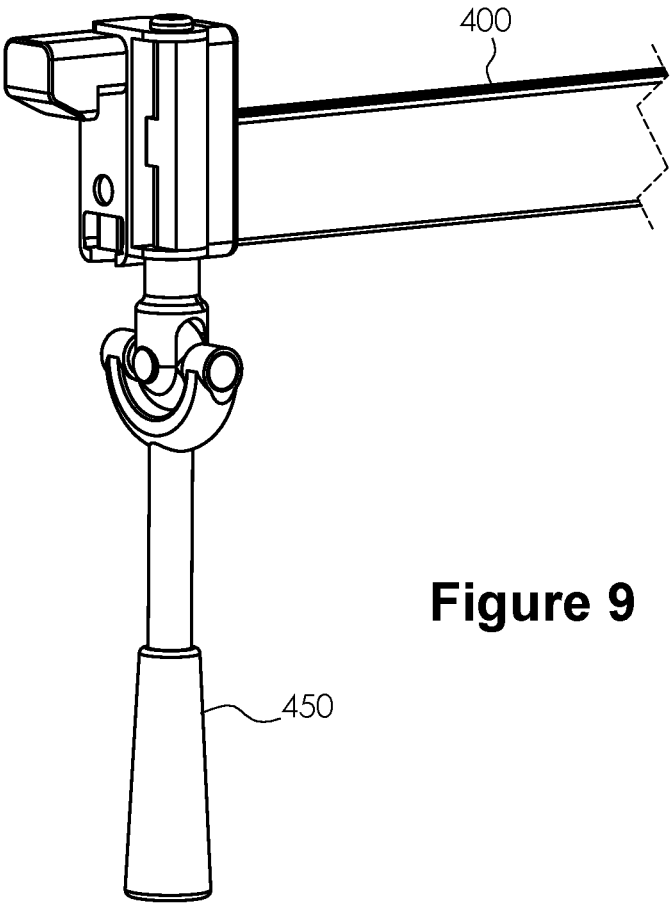
FIG. 9 illustrates an exemplary handle in a closed position, in accordance with various embodiments.
Figure 10:
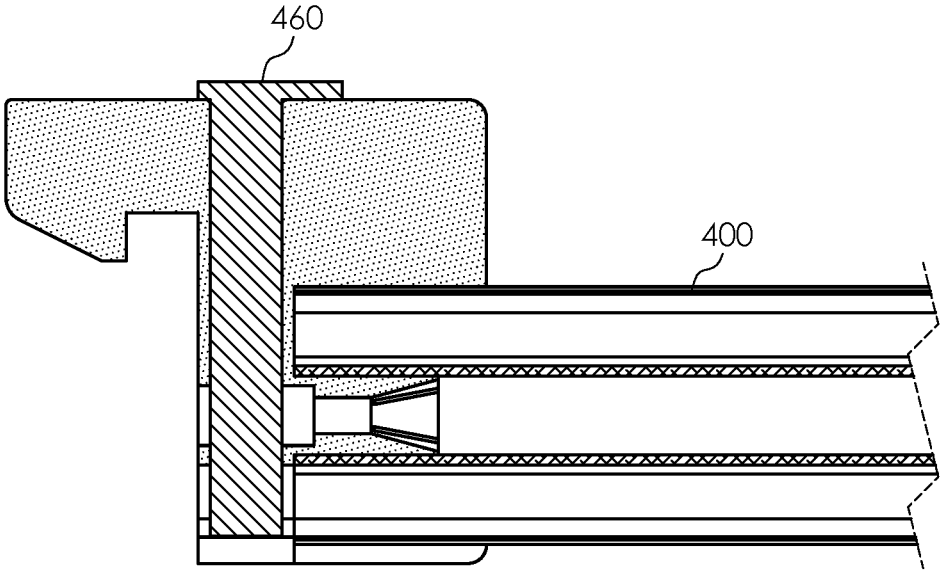
FIG. 10 illustrates an exemplary handle in a closed position, in accordance with various embodiments.
Figure 11:
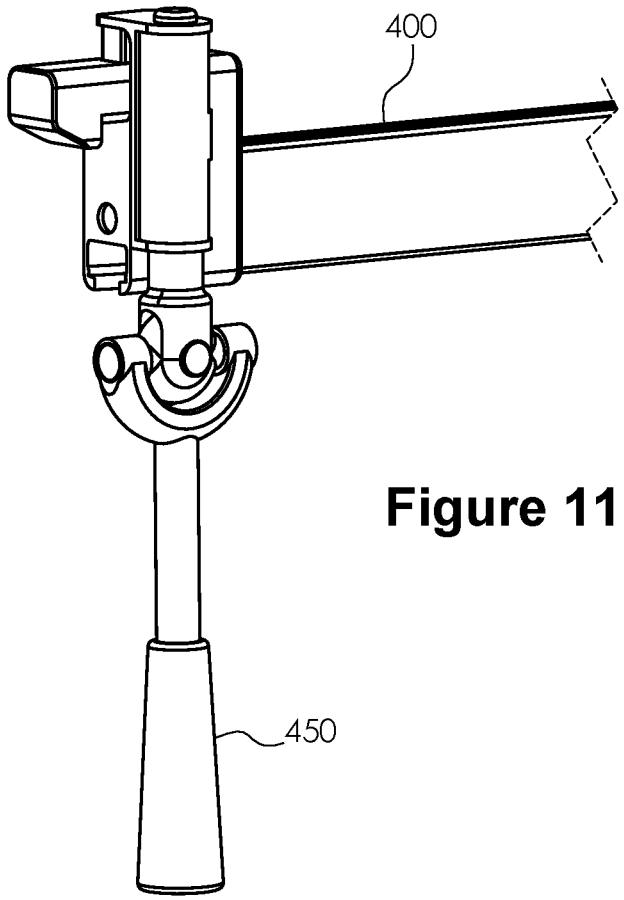
FIG. 11 illustrates an exemplary handle in an opened position, in accordance with various embodiments.
Figure 12:
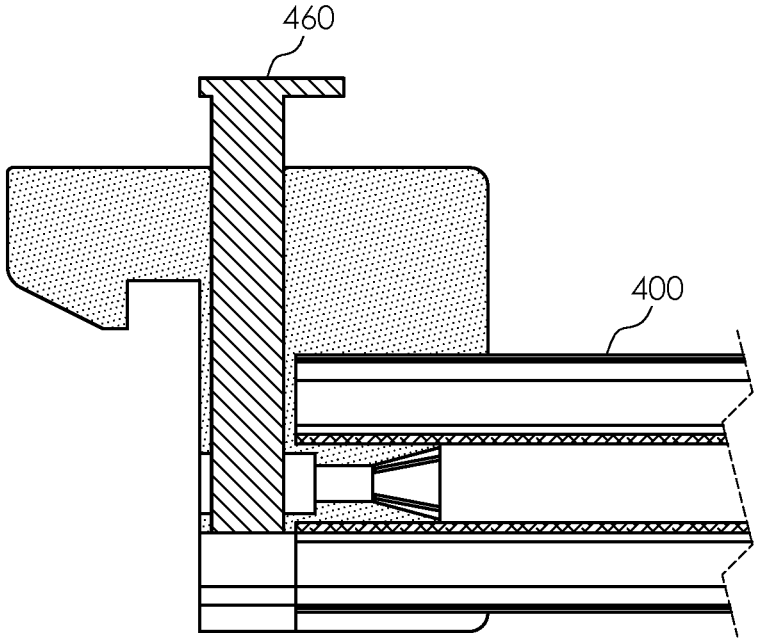
FIG. 12 illustrates an exemplary handle in an opened position, in accordance with various embodiments.

As set forth in FIGS. 9-12, in various embodiments, handle 450 may provide a means of sliding a gate 460 across the male track from the opened position (allowing the passage of a patient lift that slides along track 400) as in FIGS. 11 and 12, to the closed position (restricting the patient lift) as in FIGS. 9 and 10. Handle 250 may also function as a latch for gate 460 that, when gate 460 is closed as in FIGS. 9 and 10, gate 460 prevents the curtain hangers from sliding through (thus preventing the curtain from falling to the floor). When the handle 250 moves gate 460 into the open position as in FIGS. 11 and 12, gate 460 allows the curtain hangers to pass through the omni cube 200 to a continuing track 400. When the handle 250 is in the open position, handle 250 may be configured to allow for unloading the curtain from the track 400. See FIGS. 10 and 11 for the closed position, and FIGS. 12 and 13 for the open position. The handle 450 may include a bracket portion. The handle 450 may be connected to the bracket portion by a swivel or rotation device to allow the handle 450 portion to rotate to the open and closed positions. Handle 450 may terminate about $6\frac{11}{16}$ inches below the bottom of track 400. The bracket portion may also interface with the omni cube 200 to lock the handle 450 in place.

The detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that logical and mechanical changes may be made without departing from the spirit and scope of the disclosure. Thus, the detailed description herein is presented for purposes of illustration only and not of limitation. For example, the steps recited in any of the method or process descriptions may be executed in any order and are not limited to the order presented. Moreover, any of the functions or steps may be outsourced to or performed by one or more third parties. Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set. Furthermore, any reference to singular includes plural embodiments, and any reference to more than one component may include a singular embodiment. Although specific advantages have been enumerated herein, various embodiments may include some, none, or all of the enumerated advantages.

In the detailed description herein, references to "various embodiments," "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Benefits, other advantages, and solutions to problems have been described herein with regard to specific embodiments. However, the benefits, advantages, solutions to problems, and any elements that may cause any benefit, advantage, or solution to occur or become more pronounced are not to be construed as critical, required, or essential features or elements of the disclosure. The scope of the disclosure is accordingly limited by nothing other than the appended claims, in which reference to an element in the singular is not intended to mean "one and only one" unless explicitly so stated, but rather "one or more." Moreover, where a phrase similar to 'at least one of A, B, and C' or 'at least one of A, B, or C' is used in the claims or specification, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Although the disclosure includes a method, it is contemplated that it may be embodied as computer program instructions on a tangible computer-readable carrier, such as a magnetic or optical memory or a magnetic or optical disk. All structural, chemical, and functional equivalents to the elements of the above-described various embodiments that are known to those of ordinary skill in the art are expressly incorporated herein by reference and are intended to be encompassed by the present claims. Moreover, it is not necessary for a device or method to address each and every problem sought to be solved by the present disclosure, for it to be encompassed by the present claims. Furthermore, no element, component, or method step in the present disclosure is intended to be dedicated to the public regardless of whether the element, component, or method step is explicitly recited in the claims. No claim element is intended to invoke 35 U.S.C. § 112(f) unless the element is expressly recited using the phrase "means for" or "step for". As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

I claim:

1. A partition curtain system comprising:

a cube having a plurality of holes;

a track having a first end and a second end;

the first end of the track removably coupled with a wall;

the second end of the track removably received within a sliding bracket;

the sliding bracket having a locking arm that is removably received within a first hole of the plurality of holes in the cube; and the sliding bracket further including a gate that alternatively prevents and allows curtain hangers from sliding through the gate.

2. The system of claim 1, further comprising a loading bracket removably coupled with the track.

3. The system of claim 1, further comprising an angled tube coupled with and supporting the track.

4. The system of claim 1, further comprising one or more angled tubes received into a second hole in the plurality of holes and supporting the cube.

5. The system of claim 1, further comprising two angled tubes in a "V" configuration that are coupled with and supporting the cube.

6. The system of claim 1, further comprising an angled tube having a first end and a second end, wherein the first end of the angled tube is removably received within a second of the plurality of holes in the cube, and wherein the second end of the angled tube is removably coupled with a ceiling of a room.

7. The system of claim 1, wherein the sliding bracket further comprises a handle usable to stabilize the system by moving the locking arm within the first hole of the plurality of holes in the cube.

8. The system of claim 1, wherein the sliding bracket further comprises a handle connected to the sliding bracket, wherein the handle interfaces with the gate and is configured to rotate to alternatively open and close the gate.

9. The system of claim 1, wherein the track is a telescoping track comprised of a female portion that removably receives a male portion, and wherein the male portion of the track includes a ramp that allows curtain hanger elements to slide along the female portion, up the ramp, then along the male portion of the track.

10. The system of claim 1, further comprising a wall mount removably coupled with the first end of the track.

11. The system of claim 1, wherein the cube is a PC/ABS blend with 10-15% glass fill.

12. The system of claim 1, further comprising at least one of a platform or an exercise device removably received within the cube.

13. The system of claim 1, further comprising a cover removably mounted over a face of the cube, wherein the cover includes cutouts to provide access to one or more of the plurality of holes.

14. The system of claim 1, further comprising:

a first angled tube removably received into a third hole of the plurality of holes and located in a first face of the cube;

a second angled tube removably received into a fourth hole of the plurality of holes and located in a second face of the cube;

a third angled tube removably received into a fifth hole of the plurality of holes and located in a third face of the cube; and wherein the track is a telescoping track that is removably received into a sixth hole of the plurality of holes and located in a fourth face of the cube.

15. The system of claim 1, wherein:

the track comprises a first track, a second track and a third track;

the first track is removably received into a seventh hole of the plurality of holes and located in a first face of the cube;

the second track is removably received into an eighth hole of the plurality of holes and located in a second face of the cube; and the third track is a telescoping track that is removably received into a ninth hole of the plurality of holes and located in a third face of the cube.

16. The system of claim 15, further comprising a set screw that at least one of restricts or locks the first track within the seventh hole of the plurality of holes in the cube.

* * * * *